US008816226B2

(12) United States Patent
Zhou

(10) Patent No.: US 8,816,226 B2
(45) Date of Patent: Aug. 26, 2014

(54) SWITCH DEVICE

(75) Inventor: Jia Zhou, Shanghai (CN)

(73) Assignee: Omron Corporation, Kyoto (JP)

( * ) Notice: Subject to any disclaimer, the term of this patent is extended or adjusted under 35 U.S.C. 154(b) by 154 days.

(21) Appl. No.: 13/588,862

(22) Filed: Aug. 17, 2012

(65) Prior Publication Data

US 2013/0047778 A1 Feb. 28, 2013

(30) Foreign Application Priority Data

Aug. 24, 2011 (CN) ..... 2011 1 0247150

(51) Int. Cl.
*H01H 21/28* (2006.01)

(52) U.S. Cl.
CPC ..... *H01H 21/285* (2013.01)
USPC ..... 200/47

(58) Field of Classification Search
CPC ..... H01H 21/285; H01H 21/28
USPC ..... 200/47, 564–572, 336, 332
See application file for complete search history.

(56) References Cited

U.S. PATENT DOCUMENTS 2,015,553 A * 9/1935 Exner ..... 200/336
3,364,318 A * 1/1968 Bulliet ..... 200/47
5,954,192 A * 9/1999 Iitsuka ..... 200/336
6,627,827 B2 9/2003 Low et al.
2005/0167255 A1 * 8/2005 Howie ..... 200/336

FOREIGN PATENT DOCUMENTS

| | | |
|---|---|---|
| CN | 100449664 | 4/2003 |
| JP | 58-002937 | 1/1983 |
| JP | 05-087903 | 4/1993 |
| JP | 11-283466 | 10/1999 |
| JP | 2002-329441 A | 11/2002 |
| JP | 2006-351302 A | 12/2006 |

* cited by examiner

*Primary Examiner* — Felix O Figueroa
(74) *Attorney, Agent, or Firm* — Foley & Lardner LLP

(57) ABSTRACT

A switch device with a greatly strengthened limit structure where damage in the limit structure can be quickly detected and the structure can be easily replaced. The switch device includes a housing; a rotating shaft supported inside the housing and rotatable around its axis; a sway rod outside the housing, which is mounted at the end of the rotating shaft and configured to sway around the rotating axis of the rotating shaft by an external force applied outside the housing; a movable part outside the housing, which is configured to rotate together with the sway rod around the rotating axis of the rotating shaft; and a limit bearing part outside the housing and fixed relative to the housing, when the movable part is abutted on the limit bearing part, the swaying of the sway rod is limited, and the rotating shaft stops rotating.

5 Claims, 10 Drawing Sheets

SWITCH DEVICE

CROSS-REFERENCE TO RELATED APPLICATIONS

This application claims priority to Chinese Patent Application No. 201110247150.9, filed on Aug. 24, 2011, the entire contents of which are incorporated by reference.

TECHNICAL FIELD

The present embodiments relate to a switch device, in particular to a limit structure of a sway rod type limit switch.

BACKGROUND ART

FIG. 14 is an external view of the existing sway rod type limit switch 200, illustrating a state of the sway rod 201 of the sway rod type limit switch 200 at the free position under no external force. FIG. 15 is a top perspective view of the existing sway rod type limit switch 200 with its top cover 210 removed, illustrating a state of the sway rod 201 of the sway rod type limit switch 200 at the extreme position. As shown in FIG. 15, a rotating shaft 203 is contained inside the housing 202 of the existing sway rod type limit switch 200. Moreover, a resin cam 204 is mounted at one end of the rotating shaft 203. A transmission protruding part 205 and a limit protruding part 206 protruding towards the outside of the radial direction of the cam 204 and extending along the circumferential direction of the cam 204 are formed on a part of the external circumference of the cam 204. Besides, the other end of the rotating shaft 203 extends out of the housing 202 and is fixedly connected with the base end of the sway rod 201 outside the housing through a threaded component 207. A stress roller 208 is arranged at the free end of the sway rod 201. Therefore, when the external force generated by the impact of the controlled equipment and the like is applied on the stress roller 208 to enable the sway rod 201 to sway, the sway rod 201 drives the rotating shaft 203 to rotate, so as to enable the cam 204 mounted on the rotating shaft 203 to rotate at the same time. Then, the transmission protruding part 205 drives the switch component (not shown in the figure) located below the cam 204 to act, thereby controlling the on/off of the controlled equipment. In addition, a torsion spring 220 is wound on the external circumference of the rotating shaft 203. The rotating shaft 203 can restore to the initial free position as shown in FIG. 14 under the action of the torsion spring 220 when the external force applied on the stress roller 208 disappears, so that the switch component restores to its initial on-off state.

The limit protruding part 206 is used for limiting the swaying of the sway rod 201 and the rotation of the rotating shaft 203. Two bosses 209 protruding inside the housing 202 are respectively formed on the internal surfaces at left and right sides of the housing 202. When the sway rod 201 sways to the extreme position as shown in FIG. 15, the limit protruding part 206 is abutted with the boss 209, so that the sway rod 201 and the rotating shaft 203 stop rotating. FIG. 15 illustrates the state of the sway rod 201 which sways clockwise from the free position shown in FIG. 14 to the extreme position at which the limit protruding part 206 is abutted with the boss 209 of one side and therefore limited. Likewise the state of the sway rod 201 which sways counterclockwise from the free position shown in FIG. 14 to the extreme position at which the limit protruding part 206 is abutted with the boss 209 of the other side and therefore limited.

One example of background art is disclosed in CN 100449664C. The counterpart U.S. case to CN 100449664C is U.S. Pat. No. 6,627,827.

PROBLEMS IN THE BACKGROUND ART

In the background art, however, the housing with the bosses on its internal surface is usually metal die-casting part in the above mentioned sway rod type limit switch. At the same time the cam used for changing the action of the sway rod to that of the switch is mostly made of resin. Therefore, the limit protruding part on the resin cam is directly abutted with the metal boss inside the housing and bears the external acting force at the extreme position during the use of the sway rod type limit switch. The resin cam, especially the root part of its limit protruding part is easily damaged in case of greater external force applied or numerously repeated limiting. Besides, the cam is disposed inside the sway rod type limit switch, the damage of the cam is thus hard to be noticed, which will affect the judgment of users. Moreover the limit switch has to be entirely abandoned due to its unrepairability after damage.

SUMMARY

The present embodiments are made to solve the above problems and aims at providing a switch device with a greatly strengthened limit structure, and even if the limit structure is damaged, the damage can be quickly detected and the switch device can be easily replaced.

According to an embodiment, the switch device comprises a housing with a switch component installed in the housing; a rotating shaft inside the housing and rotatable around a rotating axis of the rotating shaft, the rotating shaft having one end for installing an external part outside the housing to drive the switch component by the rotation of the rotating shaft; a sway rod outside the housing, the sway rod at the end of the rotating shaft and configured to sway around the rotating axis of the rotating shaft by an external force applied outside the housing and to drive the rotating shaft to rotate; a movable part outside the housing and configured to rotate together with the sway rod around the rotating axis of the shaft; and a limit bearing part outside the housing and fixed relative to the housing, wherein when the movable part abuts the limit bearing part, the swaying of the sway rod is limited and the rotating shaft stops rotating.

The limiting structure (the movable part and the limiting bearing part) used for limiting the sway rod in the switch device is disposed outside the housing, so the user can be aware of whether the limiting structure of the switch device is damaged from outside the housing during usage, and the usage safety of the switch device is improved. Even if the limiting structure is damaged due to extremely great abnormal external force, it is not necessary to abandon the whole switch device. Only the damaged movable part is to be replaced and the replacing method is simple, which helps to lower the cost.

Preferably, the movable part connects to the end of the rotating shaft and the sway rod through a ring part that is integrated with the movable part and fixedly on the external circumference of the end of the rotating shaft relative to the rotating shaft through an internal circumference of the ring part, and the sway rod is detachably on an external circumference of the ring part.

Preferably, a connecting hole part is on a base end of the sway rod, a plurality of same-shaped indexing convex strips distributed at equal intervals along the circumferential direction and extending along an axial direction are on either an internal circumference of the connecting hole part or the external circumference of the ring part, while indexing grooves corresponding to the plurality of same-shaped indexing convex strips are formed on another side thereof, when the sway rod is on the ring part by the connecting hole part, the plurality of indexing grooves and the plurality of same-shaped indexing convex strips are buckled one by one.

As mentioned above, the sway rod is detachably mounted on the ring part, and the indexing convex strips and the indexing grooves are respectively arranged at the connecting part of the sway rod and the ring part. Therefore, the initial angle of the switch device can be adjusted by dismounting the sway rod and adjusting its mounting angle in the ring part, so that the switch device can meet different stroke requirements. In addition, the indexing convex strips and the indexing grooves are uniformly distributed along the external circumference of the ring part or the internal circumference of the connecting hole part respectively, therefore, the mounting angle of the sway rod in the ring part can be quantitatively adjusted.

The movable part and the sway rod can be integrated for specific users who do not need to adjust the initial position of the sway rod.

In addition, it is necessary to ensure that the switch component inside the housing completes the switching action reliably when the sway rod reaches the limited extreme position. Therefore, the switch device of the embodiment is characterized in that a sway angle of the sway rod swaying from a free position under no external force to a limit position at which the movable part abuts the limit bearing part is greater a sway angle of the sway rod swaying from a free position under no external force to an acting position at which the switch component acts.

Preferably, the limit bearing part and the housing are integrated. Thus, the limit bearing part is molded directly during the casting process of the housing. It is easily manufactured and the limit bearing part has high strength as a die-casting part.

Preferably, the limit bearing part and the movable part are made of metal materials. Thus, the limit structure of the switch device can bear much greater acting force due to higher tensile strength of the metal materials.

BRIEF DESCRIPTION OF THE DRAWINGS

FIG. 8(*b*) is a perspective view of the limit switch at the acting position.

FIG. 8(*c*) is a perspective view of the limit switch at the limit position.

FIG. 12(*b*) is a perspective view of the limit switch at the extreme position with widened limit arm part and heightened boss (i.e. the limit bearing part).

FIG. 13(*b*) is a perspective view of an adjustable sway rod type limit switch with the limiting structure of the embodiment.

DETAILED DESCRIPTION

The detailed description of preferred embodiments is given below by taking the sway rod type limit switch as an example with reference to the attached drawings.

The First Embodiment

Figure 1:
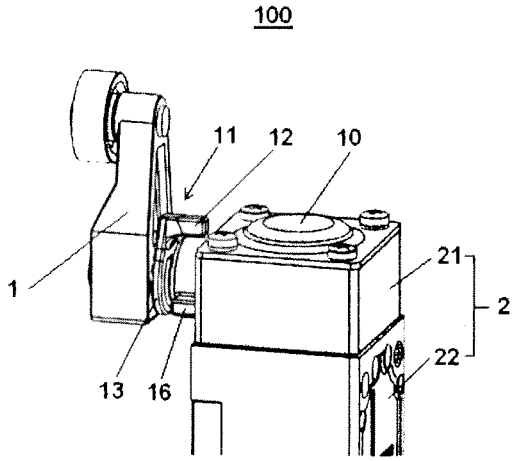
FIG. 1 is a perspective view of the sway rod type limit switch in the first embodiment of the embodiment, illustrating a state of the sway rod at the free position under no external force.
Figure 2:
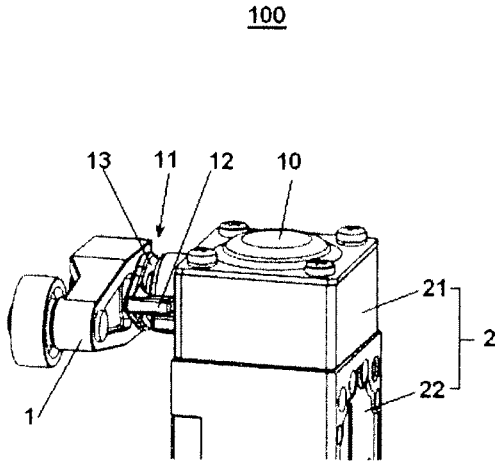
FIG. 2 is a perspective view of the sway rod type limit switch in the first embodiment of the embodiment, illustrating a state of the limited sway rod at the extreme position on one side.
Figure 3:
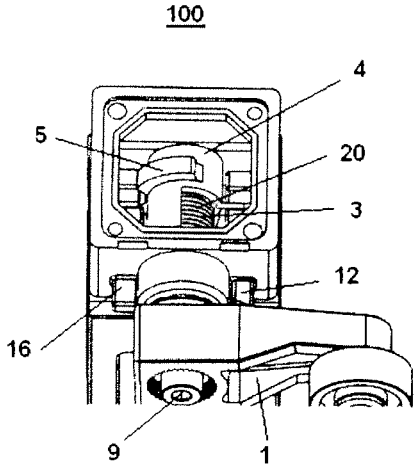
FIG. 3 is a perspective view of the sway rod type limit switch with its top cover removed in the first embodiment, illustrating a state of the limited sway rod at the extreme position on one side.
Figure 4:
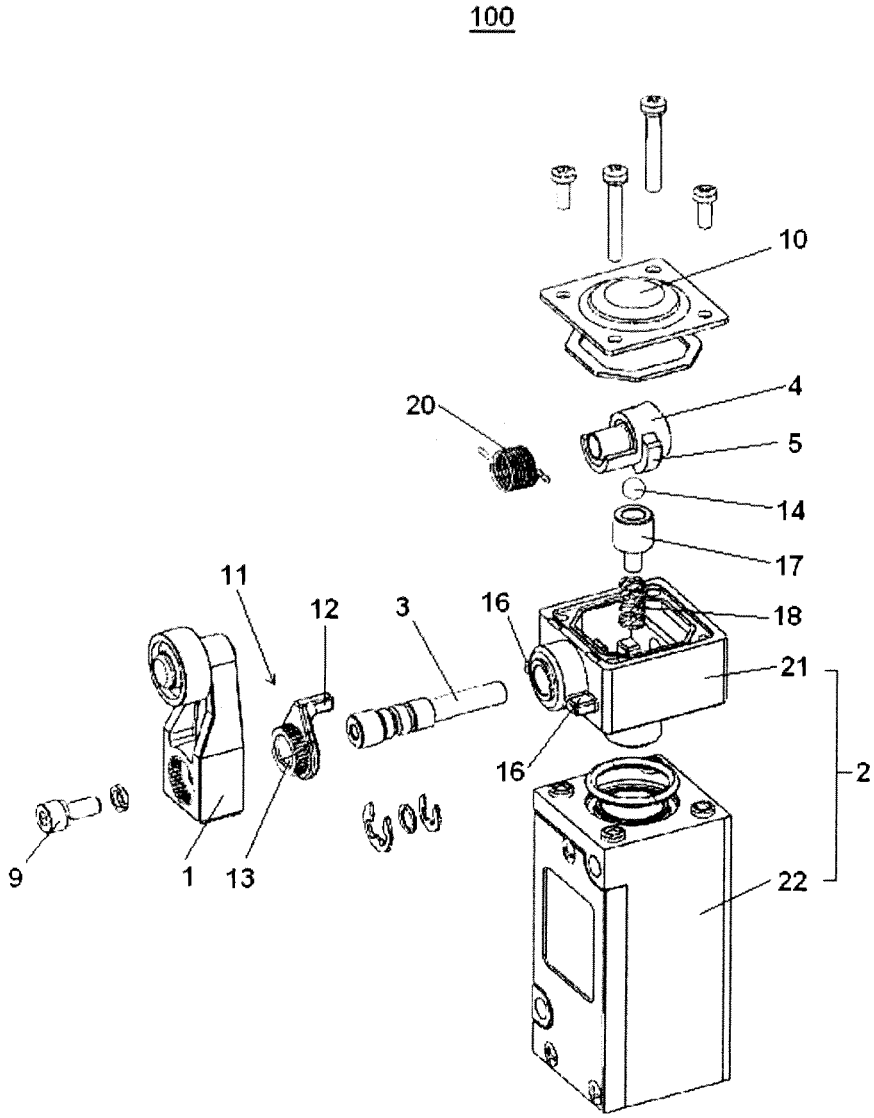
FIG. 4 is an exploded perspective view of the sway rod type limit switch in the first embodiment.

FIGS. 1 and 2 are perspective views of the sway rod type limit switch 100 in the first embodiment. FIG. 1 illustrates the sway rod 1 at the free position under no external force. FIG. 2 illustrates the sway rod 1 limited at the extreme position on one side. FIG. 3 is the partial perspective view illustrating the sway rod type limit switch 100 in the first embodiment, in particular a state of the limited sway rod 1 at the extreme position on one side with the top cover 10 of the sway rod type limit switch 100 removed. FIG. 4 is the exploded perspective view of the sway rod type limit switch 100.

As shown in FIGS. 1 to 4, the sway rod type limit switch 100 in the first embodiment has a housing 2 made of metal material, such as zinc alloy. The housing 2 is composed of a die-cast head housing 21 and a switch housing 22. A switch component for controlling the on/off of the controlled equipment is contained in the switch housing 22 (not shown in the figure). A rotating shaft 3 is contained in the head housing 21, and rotates around a rotating axis of the rotating shaft 3 relative to the housing 2, so as to enable the switch component to act. One end of the rotating shaft 3 (hereinafter referred to as outer end) protrudes out of the head housing 21. A sway rod 1 outside the housing 2 is arranged on the outer end of the rotating shaft 3 through a threaded component 9, and can sway around the axis of the rotating shaft 3 under the action of the external force, so as to drive the rotating shaft 3 to rotate. A resin cam 4 is arranged at the other end (hereinafter referred to as inner end) of the rotating shaft 3 inside the head housing 21 and fixed relative to the rotating shaft 3, rotating together with the rotating shaft 3. A transmission protruding part 5 protruding towards the radial direction of the cam and extending along the circumferential direction of the cam is formed on a part of the external circumference of the resin cam 4. When the resin cam 4 is driven by the rotating shaft 3 to rotate and thereby cause contact between the external circumference of the transmission protruding part 5 and a ball 14 (refer to FIG. 4) below the cam 4, a switch-driven plunger 17 (refer to FIG. 4) engaged with the ball 14 is pushed downwards, so that the switch component in the switch housing 22 performs on/off action (the position of the sway rod 1 is now called acting position). A torsion spring 20 is wound on the external circumference of the rotating shaft 3. Therefore, the rotating shaft 3 can restore to the initial free position as shown in FIG. 1 under the action of the torsion spring 20 when the external force applied to the sway rod 1 disappears, releasing the contact between the transmission protruding part 5 of the cam 4 and the ball 14. In consequence, the switch-driven plunger 17 moves upward under the action of a return spring 18, and the switch component restores to the original state.

Figure 5:
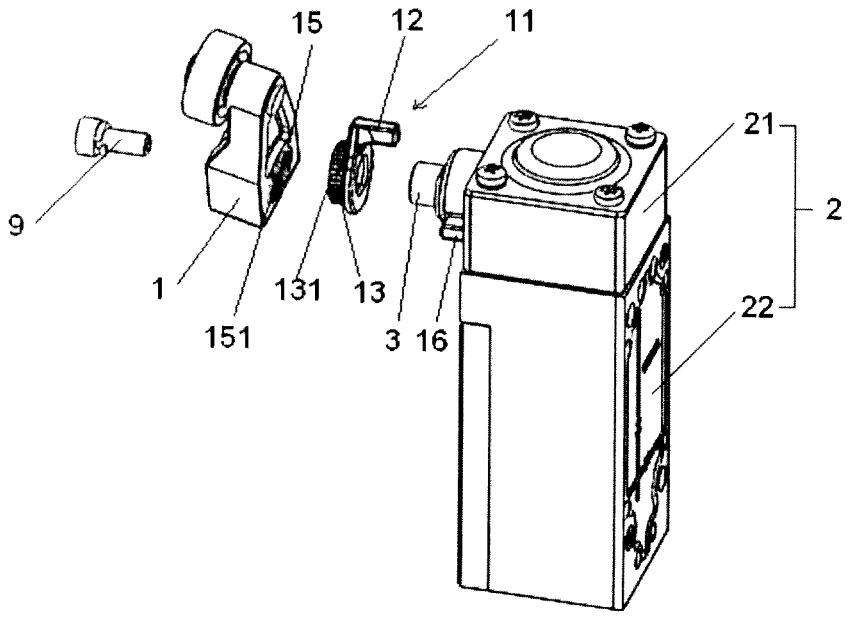
FIG. 5 is an exploded perspective view illustrating the connecting method of the sway rod and the rotating shaft in the first embodiment.

FIG. 5 is an exploded perspective view illustrating the connecting method of the sway rod 1 and the rotating shaft 3. As shown in FIG. 5, in this embodiment, the sway rod 1 is connected to the rotating shaft 3 by a buckle 11 made of metal material such as zinc alloy, which consists of a limit arm part 12 (i.e. the movable part) and a toothed ring part 13 (i.e. the ring part). The limit arm part 12 is used for abutting with a limit bearing part 16 at the limiting position to limit the sway rod 1, and the toothed ring part 13 is used for connecting the sway rod 1 and the rotating shaft 3.

The toothed ring part 13 of the buckle 11 is fixedly arranged on the external circumference of the outer end of the rotating shaft 3 relative to the rotating shaft 3 through an internal circumference of the toothed ring part 13. The sway rod 1 is detachably mounted on the external circumference of the toothed ring part 13 and can drive the buckle 11 and the rotating shaft 3 to rotate together.

As shown in FIG. 5, a plurality of same-shaped indexing convex strips 131 distributed at equal intervals along the circumferential direction and extending along the axial direction are formed on the external circumference of the toothed ring part 13. A connecting hole part 15 is formed at the base end of the sway rod 1. Indexing grooves 151 corresponding to the indexing convex strips 131 are formed on the internal circumference of the connecting hole part 15. When the sway rod 1 is detachably mounted on the toothed ring part 13 by the connecting hole part 15, the indexing convex strips 131 and the indexing grooves 151 are buckled one by one. Then, the sway rod 1 is fixed at the outer end of the rotating shaft 3 by a threaded component 9 which runs through the hole bottom part of the connecting hole part 15 and is engaged with internal threads of the outer end of the rotating shaft 3.

In addition, the limit arm part 12 of the buckle 11 is arm-shaped, erecting along the radial direction from the partial periphery of the toothed ring part 13 and extending towards the head housing 21 along the axial direction. Two bosses 16 (i.e. limit bearing parts) for limiting the sway rod 1 and the rotating shaft 3 are integrated on the external surface of the head housing 21 towards the sway rod 1, as shown in FIGS. 2 and 3, when the side surface of the limit arm part 12 abuts the upper surface of either boss 16, the swaying of the sway rod 1 is limited, and the rotating shaft 3 stops rotating. It means the sway rod 1 reaches its maximum stroke and the extreme position at the two bosses 16.

As shown in FIGS. 1 to 4, in this embodiment, the sway rod 1 stands upward vertically (hereinafter referred to as at the 0° position) in the free state under no external force, and the limit arm part 12 of the buckle ills also at the 0° position. That is, the limit arm part 12 is overlapped with the axis of the rotating shaft 3 from the top view, and the two bosses 16 are respectively formed at the position tilting 90° in the clockwise direction or the counterclockwise direction with the 0° position as the center. Therefore, in this state, when the sway rod 1 sways 90° from the free position, i.e. 0° position, in the clockwise direction or the counterclockwise direction, the limit arm part 12 of the buckle 11 is abutted with the boss 16 at one side so as to be limited. At this time, the sway rod 1 and the rotating shaft 3 are fixedly connected together with the buckle 11, thus the sway rod 1 and the rotating shaft 3 reach the swaying or rotating extreme position and stop moving. That is to say, the sway rod 1 sways 90° clockwise or counterclockwise with the 0° position as the center under the position relationship of the sway rod 1, the buckle 11 and the bosses 16 as shown in FIGS. 1 to 4. Likewise, the rotating shaft 3 also rotates 90° clockwise or counterclockwise with the 0° position as the center.

In addition, the mounting angle of the sway rod 1 relative to the buckle 11, namely, the free position of the sway rod 1 (the initial position of the limit switch 100) can be adjusted quantitatively through the indexing convex strips 131 on the external circumference of the toothed ring part 13 and the indexing grooves 151 on the internal circumference of the connecting hole part 15 of the sway rod 1, so that the extreme position of the sway rod 1 is also adjusted by quantitatively.

Figure 6:
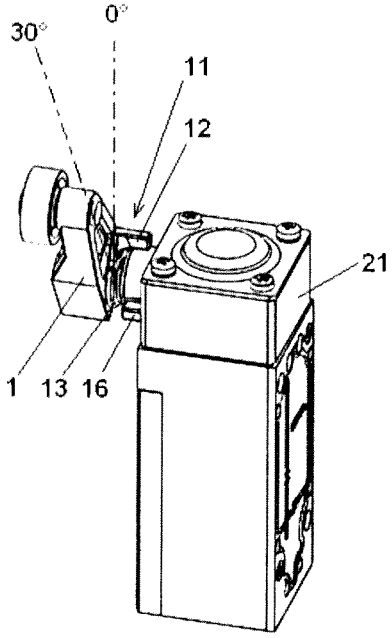
FIG. 6 is a perspective view of the sway rod in the first embodiment, illustrating a state of the sway rod at the free position tilting 30° from the vertical direction.
Figure 7:
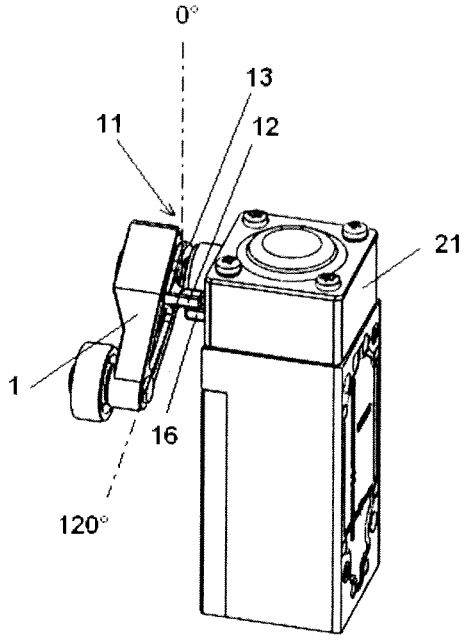
FIG. 7 is a perspective view of the sway rod in the first embodiment, illustrating a state of the sway rod at the extreme position tilting 120° from the vertical direction.

Specifically, for example, as shown in FIG. 6, If the sway rod 1 is mounted tilting 30° clockwise from the 0° position (i.e. the initial position of the limit switch 100 is at the position tilting 30° clockwise in the vertical direction) when the buckle 11 is fixedly connected to the rotating shaft 3 (refer to FIG. 5) with the limit arm part 12 at the 0° position and the boss 16 on the head housing 21 is at the 90° position, the indexing convex strips 131 and the indexing grooves 151 (refer to FIG. 5) are buckled one by one. Therefore, the sway rod 1 is mounted on the external circumference of the toothed ring part 13 as shown in FIG. 7, and the extreme position of the sway rod 1 in clockwise direction is 120° position tilting clockwise from 0° position (vertical direction). The extreme position of the sway rod 1 in counterclockwise direction is 60° position tilting counterclockwise from 0° position (vertical direction) (figures omitted).

Figure 8A:
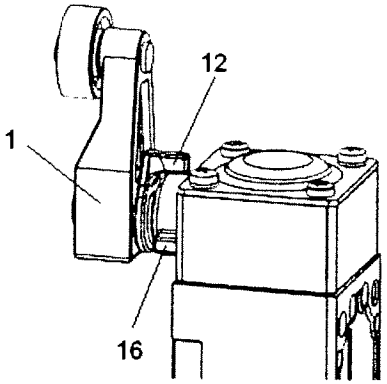
FIG. 8(*a*) is a perspective view of the limit switch in the first embodiment at the free position.
Figure 8B:
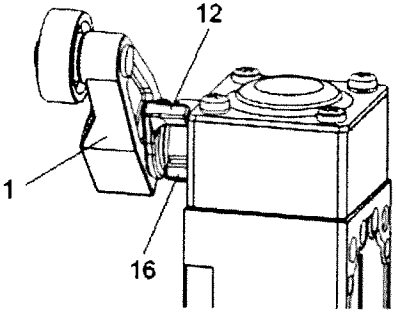
Figure 8C:
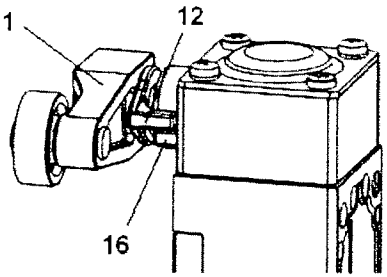

It is guaranteed that the switch component in the switch housing 22 reliably performs the on/off action when the sway rod 1 reaches the extreme position to be limited. So, the limit switch 100 is characterized in that the rotating angle of the sway rod 1 from the free position under no external force to the extreme position at which the limit arm part 12 is abutted with the boss 16 is greater than that of the sway rod 1 from the free position to the acting position at which the switch component is enabled to act. FIG. 8 illustrates the rotating angle relationship of the limit switch at the free position, acting position, and the limit position. FIG. 8(*a*) shows the limit switch at the free position; FIG. 8(*b*) shows the limit switch at the acting position, and FIG. 8(*c*) shows the limit switch at the limiting position.

In the embodiment, the impact parts (the limit arm part 12 of the buckle 11 and the boss 16 integrated on the head housing 21 in the die-casting process) are made of metal material in the limiting process. In the background art, however, the limit protruding part 206 integrated on the resin cam 204 as the limiting impact part is a resin component and the boss 209 integrated on the internal surface of the housing 202 as the other impact part is a metal component. The external force between the metal components in the embodiment is obviously bigger than that between the resin component and the metal component in the background art. Specially, the buckle 11 is made of ZDC2 (2 types of zinc alloy die-casting parts) with tensile strength more than 283 $N/mm^2$. In the background art, the cam 204 with the limit protruding part 206 is generally made of POM (polyoxymethylene resin) with its tensile strength about 58 $N/mm^2$. It can be proved through the stress analysis and test that, the limiting structure of the sway rod in the embodiment can withstand load at least 3 times more than that of the existing product without any damage.

In the embodiment, the limit arm part 12 for limiting the sway rod 1 and the boss 16 are formed outside of the housing 2. The user can make sure whether the limiting structure of the limit switch is damaged from outside the housing during the using process, so that the usage safety of the limit switch is improved. The damaged buckle 11 only needs to be replaced without abandoning the whole limit switch even if the switch is damaged by the abnormal external force. The replacing method is easy and the cost is lowered.

In the above embodiment, the limiting force is applied directly to the buckle 11 at the limiting position, but not directly applied to the rotating shaft 3. The deformation and affected acting precision of the rotating shaft 3 due to long-time using of the limit switch 100 can be avoided, and the service life of the product is prolonged.

In the embodiment, the sway rod 1 is detachably mounted on the buckle 11, and the indexing convex strips 131 and the indexing grooves 151 are respectively formed at the connecting part of the buckle 11 and the sway rod 1. Therefore, the angle of the sway rod 1 at the free position relative to the housing can be adjusted by dismounting and adjusting the mounting angle of the sway rod 1 in the buckle 11, so that the limit switch can meet different stroke requirements. The indexing convex strips 131 are uniformly distributed along the external circumference of the toothed ring part 13 and the indexing grooves 151 are uniformly distributed along the internal circumference of the connecting hole part 15, so that the mounting angle of the sway rod 1 in the buckle 11 can be adjusted quantitatively.

In addition, in the embodiment, the buckle 11 comprising the limit arm part 12 and the head housing 21 comprising the boss 16 are both integrated die-casting parts which are easy to produce and the limit arm part 12 and the boss 16 have higher strength.

The Second Embodiment

Figure 9:
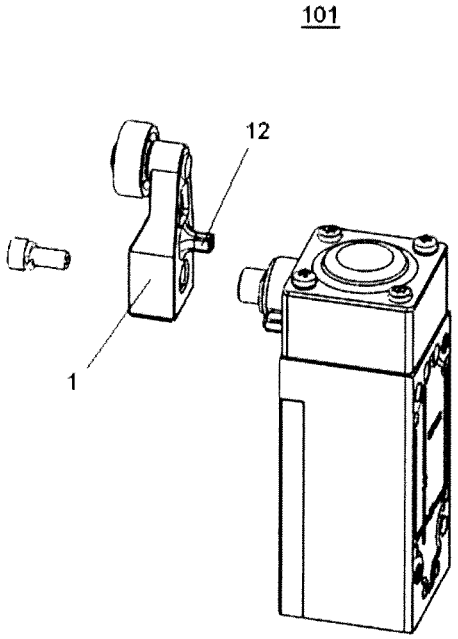
FIG. 9 is an exploded perspective view of the limit switch in the second embodiment.
Figure 10:
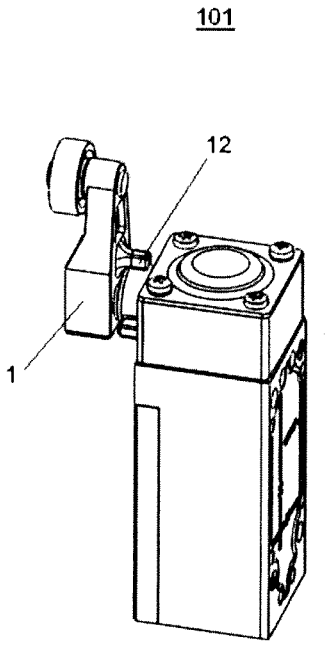
FIG. 10 is a perspective view of the assembled limit switch in the second embodiment.

FIG. 9 is an exploded perspective view of a limit switch 101 in the second embodiment. FIG. 10 is a perspective view of the assembled limit switch 101 in the second embodiment. Compared with the first embodiment, the buckle and the sway rod of the limit switch 101 in the second embodiment are of an integrated structure, i.e. the buckle is not independently arranged and the limit arm part 12 (the movable part) as one of the limit structure is directly formed on the internal surface of a sway arm of the sway rod 1.

For specific users who do not need to adjust the initial position of the limit switch, the limit switch 101 in the second embodiment has fewer parts and simpler structure and lower cost. In addition, the strength of the integrated limiting structure, which incorporates both the movable part and the sway rod, is bigger than that as they are separate.

The Third Embodiment

Figure 11:
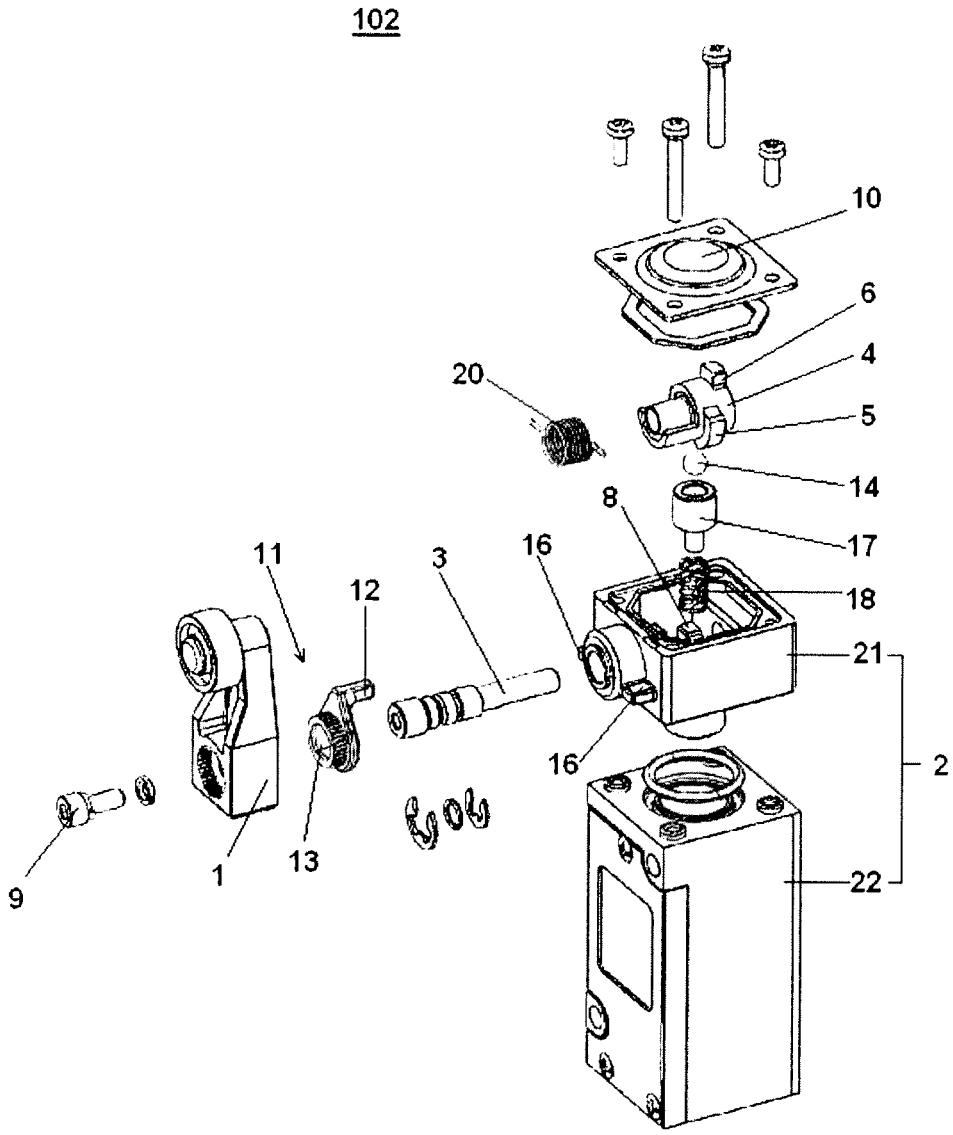
FIG. 11 is an exploded perspective view of the sway rod type limit switch in the third embodiment.

FIG. 11 is an exploded perspective view of a sway rod type limit switch 102 in the third embodiment. Different from the limiting structure of the sway rod and the rotating shaft in the first and the second embodiments, a limit protruding part 6 on a resin cam 4 in the existing product and a boss 8 formed in the housing are still retained in the sway rod type limit switch 102 of the third embodiment besides a limit arm part 12 and a boss 16 outside the housing. Furthermore, the sway range of the sway rod limited by the limiting structure outside the housing, that is, the limit arm part 12 and the boss 16, is greater than or equal to that of the sway rod limited by the limiting structure inside the housing, that is, the limit protruding part 6 on the cam 4 and the boss 8 in the housing. But, when the sway range of the sway rod limited by the limit arm part 12 and the boss 16 is bigger than that limited by the limit protruding part 6 on the cam 4 and the boss 8 in the housing, the sway range of the sway rod limited by the limit arm part 12 and the boss 16 is no more than the maximum elastic deformation range when the limit protruding part 6 on the cam 4 reaches the limiting position.

In this circumstance, when the sway rod type limit switch 102 is used normally, the strokes of the sway rod 1 and the rotating shaft 3 are limited by the limit protruding part 6 and the boss 8 inside the housing. On the other hand, when the limit protruding part 6 inside the housing is damaged and fails to work due to extraordinarily high abnormal external force (overload) applied on the sway rod 1, the limiting structure outside the housing, that is, the limit arm part 12 and the boss 16 can limit and protect the secondary stroke position.

Figure 12A:
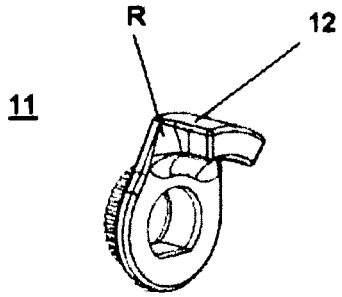
FIG. 12(*a*) is a perspective view of a limit arm part (i.e. the movable part) with increased width.
Figure 12B:
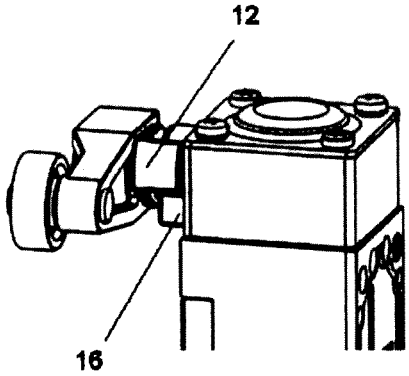

To achieve the above limiting and protection functions of the limit arm part 12 and the boss 16 in an overload condition, the structures of the limit arm part 12 and the boss 16 need to be optimized to improve their strength compared to the first and second embodiments. FIG. 12(*a*) is a perspective view illustrating the widened limit arm part 12 while the FIG. 12(*b*) is a perspective view illustrating the limit switch at the limiting position with the widened limit arm part 12 and the heightened boss 16. The limit arm part 12 and the boss 16 can bear much more loads by changing the width dimension to enhance the strength as shown in FIG. 12. The swaying of the sway rod 1 and the rotation of the rotating shaft 3 at the limiting positions will be mandatorily halted in reliability in case that the external acting force applied on the sway rod 1 is below the load.

Otherwise, to enhance the strength of the limit arm part 12, the chamfering R at the connecting part of the limit arm part 12 and the toothed ring part 13 may be enlarged as shown in FIG. 12(*a*), in addition to widening its thickness, so as to further diffuse the concentrated stress.

By adopting the sway rod type limit switch in the third embodiment, the production can be continued by using the resin cam in the existing products, and the limit switch can be secondarily protected under the overload due to the addition of a secondary limiting structure outside the housing of the limit switch.

The preferred embodiments have been described above, but are not limited thereto.

For instance, in the above embodiment, the housing 2 is composed of a head housing 21 and a switch housing 22, but is not limited hereto. The head housing 21 and the switch housing 22 also can be integrated, that is, one housing 2 can be adopted by the limit switch for containing all the internal parts.

Furthermore, in the above embodiment, one end of the rotating shaft 3 is used for installing the sway rod extending out from the head housing 21, but is not limited hereto, so long as one end of the rotating shaft is communicated with outside of the housing for installing the sway rod. For instance, a connecting shaft vertical to the sway rod and being able to be inserted into the housing also can be arranged on the sway rod, in which the sway rod is fixedly connected with one end of the rotating shaft retracted in the housing through the connecting shaft.

In the above embodiment, indexing convex strips 131 for adjusting the initial position of the limit switch are formed on the external circumference of the toothed ring part 13; and indexing grooves 151 are formed on the internal circumference of the connecting hole part 15 of the sway rod 1, but not limited hereto, indexing convex strips also can be formed on the internal circumference of the connecting hole part 15 and the indexing grooves also can be formed on the external circumference of the toothed ring part 13.

Apart from that, in the above embodiment, the buckle 11 or the sway rod 1 including the limit arm part 12, and the head housing 21 including the boss 16 are all integrated die-casting parts, but not limited hereto, the limit arm part 12 and the boss 16 can be fixed on their respective bases by using other fixing means whose fixing strength reaches the requirements of bearable acting forces, such as the welding method etc.

Figure 13A:
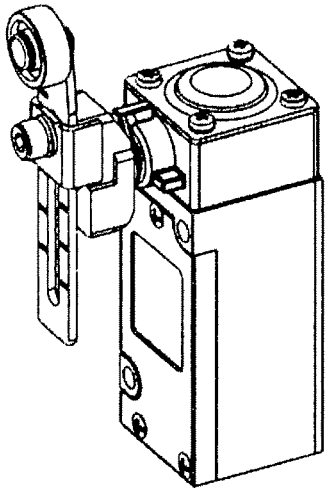
FIG. 13(*a*) is a perspective view of an adjustable ball sway rod type limit switch with the limiting structure of the embodiment.
Figure 13B:
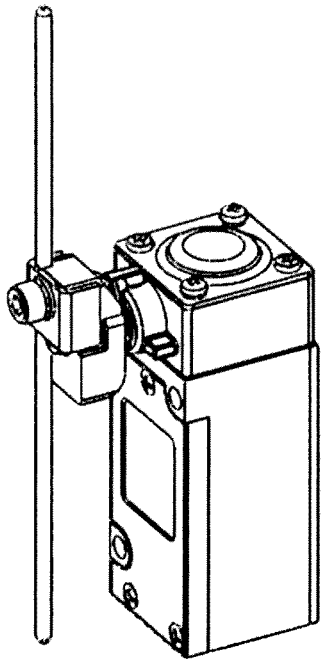
Figure 14:
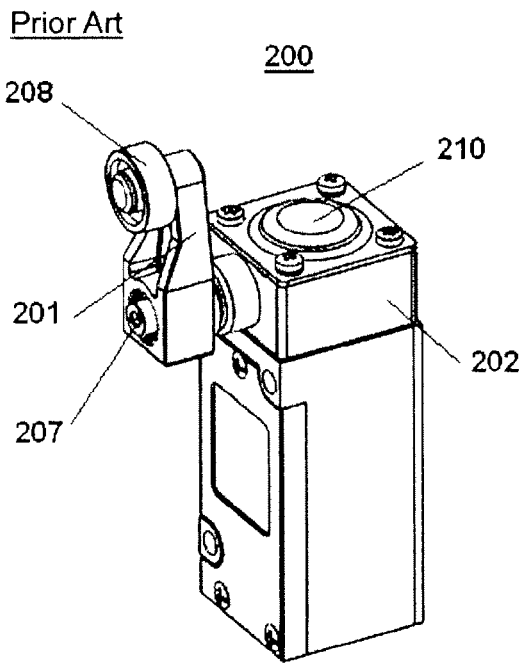
FIG. 14 is a perspective view of the existing sway rod type limit switch, illustrating a state of the sway rod of the sway rod type limit switch at the free position under no external force.
Figure 15:
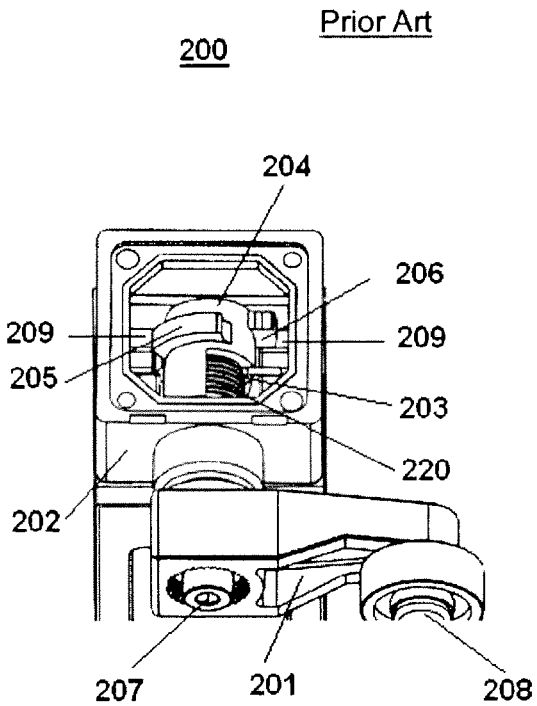
FIG. 15 is a partial perspective view of the existing sway rod type limit switch with the top cover removed, illustrating a state of the sway rod of the sway rod type limit switch at the extreme position.

On the other hand, in the above embodiment, the limiting structure of the limit switch is described with the ball sway rod type limit switch as an example, but is not limited hereto. The technical personnel of this field can easily come up with the idea of applying the embodiments to other limit switches, such as adjustable ball sway rod and adjustable sway rod type limit switches to improve the strength of the limiting structure and easily find out the damage. FIG. 13(*a*) shows an adjustable ball sway rod type limit switch with the limiting structure while FIG. 13(*b*) shows an adjustable sway rod type limit switch with the limiting structure.

The preferred embodiments are described above with the sway rod type limit switch as an example. The embodiments also can be applied to switch devices for converting the external acting forces into the switch signal and transferring to the switch component inside for on/off action besides the sway rod type limit switch.

There has thus been shown and described a novel switch device using the same which fulfills all the objects and advantages sought therefor. Many changes, modifications, variations and other uses and applications of the subject embodiments will, however, become apparent to those skilled in the art after considering this specification and the accompanying drawings which disclose the preferred embodiments thereof. All such changes, modifications, variations and other uses and applications which do not depart from the spirit and scope of the embodiments are deemed to be covered by the embodiments, which is to be limited only by the claims which follow.

Although the embodiments have been described in detail for the purpose of illustration based on what is currently considered to be the most practical and preferred embodiments, it is to be understood that such detail is solely for that purpose and that the embodiments are not limited to the disclosed embodiments, but, on the contrary, are intended to cover modifications and equivalent arrangements that are within the spirit and scope of the appended claims. For example, it is to be understood that the present embodiments contemplate that, to the extent possible, one or more features of any embodiment can be combined with one or more features of any other embodiment.

What is claimed is:

1. A switch device, comprising:

a housing with a switch component installed in the housing;

a rotating shaft inside the housing and rotatable around a rotating axis of the rotating shaft, the rotating shaft having an end for installing an external part outside the housing to drive the switch component by rotation of the rotating shaft;

a sway rod outside the housing, at the sway rod at the end of the rotating shaft and configured to sway around the rotating axis of the rotating shaft by an external force applied outside the housing and to drive the rotating shaft to rotate;

a movable part outside the housing and configured to rotate together with the sway rod around the rotating axis of the rotating shaft; and a limit bearing part outside the housing and fixed relative to the housing, wherein when the movable part abuts the limit bearing part, swaying of the sway rod is limited and the rotating shaft stops rotating;

wherein the movable part connects to the end of the rotating shaft and the sway rod through a ring part that is integrated with the movable part, wherein the ring part is fixedly on an external circumference of the end of the rotating shaft relative to the rotating shaft through an internal circumference of the ring part, and wherein the sway rod is detachably on an external circumference of the ring part.

2. The switch device according to claim 1, wherein a connecting hole part is on a base end of the sway rod, wherein a plurality of same-shaped indexing convex strips distributed at equal intervals along a circumferential direction and extending along an axial direction are on one side of an internal circumference of the connecting hole part and the external circumference of the ring part, while indexing grooves corresponding to the plurality of same-shaped indexing convex strips are formed on another side, and wherein when the sway rod is on the ring part by the connecting hole part, the plurality of indexing grooves and the plurality of same-shaped indexing convex strips are buckled one by one.

3. The switch device according to claim 1, wherein a sway angle of the sway rod swaying from a free position under no external force to a limit position at which the movable part abuts the limit bearing part is greater than a second sway angle of the sway rod swaying from the free position under no external force to an acting position at which the switch component acts.

4. The switch device according to claim 3, wherein the limit bearing part and the housing are integrated.

5. The switch device according to claim 4, wherein the limit bearing part and the movable part are made of metal materials.

* * * * *